US006006866A

United States Patent [19]

Horne et al.

[11] Patent Number: 6,006,866

[45] Date of Patent: Dec. 28, 1999

[54] ELEVATOR DOOR RESTRICTOR

[75] Inventors: Gregory L. Horne, Watauga; Tom J. Harrison, Grapevine, both of Tex.

[73] Assignee: Advanced Microcontrols, Inc., Fort Worth, Tex.

[21] Appl. No.: 09/099,120

[22] Filed: Jun. 17, 1998

Related U.S. Application Data

[63] Continuation-in-part of application No. 08/907,554, Aug. 8, 1997, which is a continuation of application No. 08/512,489, Aug. 8, 1995, Pat. No. 5,655,627.

[51] Int. Cl.[6] ..... B66B 13/14

[52] U.S. Cl. ..... 187/316; 187/331

[58] Field of Search ..... 187/316, 313, 187/315, 318, 319, 331

[56] References Cited

U.S. PATENT DOCUMENTS 4,436,184 3/1984 Dorman et al. ..... 187/29 R
4,800,741 1/1989 Kerschenbaum et al. ..... 70/13
5,655,627 8/1997 Horne et al. ..... 187/355

*Primary Examiner*—Jonathan Salata
*Attorney, Agent, or Firm*—Felsman Bradley Vaden Gunter & Dillon, LLP; James E. Bradley

[57] ABSTRACT

An elevator is provided with a car and inner and outer doors. The inner door registers with one of the outer doors when the car is disposed within a floor zone. A solenoid on the car has a plunger for blocking the inner door from opening. Power will only be applied to the solenoid to move the plunger to a retracted position to allow the inner door to be fully opened when both the car is disposed within a floor zone and the inner doors are being opened by the main elevator controls. A floor zone sensor is mounted to the car for detecting when the elevator is disposed within one of the floor zones. A door sensor is also mounted to the car for detecting when the inner door is being opened by the main elevator controls. A controller operates the electric solenoid to lift the plunger from the extended position to the retracted position in response to receiving both a door data signal from the door sensor and a floor zone data signal from the floor zone sensor. In the event of a power loss, the plunger will strike a lift clip so that the inner door may close.

15 Claims, 5 Drawing Sheets

ELEVATOR DOOR RESTRICTOR

This application is a continuation-in-part of application Ser. No. 08/907,554 filed Aug. 8, 1997, which is a continuation of Ser. No. 08/512,489 filed Aug. 8, 1995 now U.S. Pat. No. 5,655,627.

FIELD OF THE INVENTION

The present invention relates in general to controls for elevators, and in particular to an elevator door restrictor for preventing elevator doors from being opened between floors.

DESCRIPTION OF THE PRIOR ART

A new national standard for elevator codes has recently been promulgated by the American Society of Mechanical Engineers, and has been widely adopted by many local building code authorities. It requires door restrictors for blocking the inner doors of elevators from being pushed open more than a total of four inches when elevator cars are disposed between floors. The code provides a standard that the elevator must be within eighteen inches of being perfectly aligned at a floor before the door restrictor allows the inner doors to be pushed open. Preferably the inner elevator doors may be pushed open a slight distance, not more than a total of four inches, so that persons trapped within an elevator car between floors may look out into the elevator shaft, call for help and circulate fresh air. Also, in the event of a power loss while the door is open, emergency or maintenance personnel should be able to manually close the door.

Prior art elevator door restrictors have been provided by mechanical latches which prevent the inner doors of elevator cars from being pushed open when the elevator cars are between floors. The prior art mechanical latches have mechanical linkages which engage cams located at each floor to move the mechanical latches from a latched position to an unlatched position when the elevator passes by each floor. These prior art mechanical latches do not prevent the inner doors from being pushed open while elevator cars are moving past a floor. Additionally, the mechanical linkages make noise as the elevator passes each floor.

SUMMARY OF THE INVENTION

An elevator is provided with a car, an inner door mounted to the car and outer doors mounted to floor openings which define floor zones. The inner door registers with the outer doors when the car is disposed within one of the floor zones. The elevator includes a door restrictor having an electric solenoid mounted to the car so that the inner door cannot be opened more than four inches when the elevator is between floor zones.

The electric solenoid has a plunger which is normally in an extended position to block the inner door from opening. Power will only be applied to the electric solenoid to lift the plunger from the extended position to a retracted position to allow the inner door to be fully opened when both the car is disposed within a floor zone and the inner doors are being opened by the main elevator controls. A photo sensor is mounted to the car to provide a floor zone sensor for detecting when the elevator is disposed within one of the floor zones. A photo sensor is mounted to the car to provide a door sensor for detecting when the inner door is being opened by the main elevator controls. A controller operates the electric solenoid to lift the plunger from the extended position to the retracted position in response to receiving both a door data signal from the door sensor and a floor zone data signal from the floor zone sensor. In the event of a power loss, the plunger will strike a lift clip so that the inner door may close.

DETAILED DESCRIPTION OF THE PREFERRED EMBODIMENT

Figure 1:
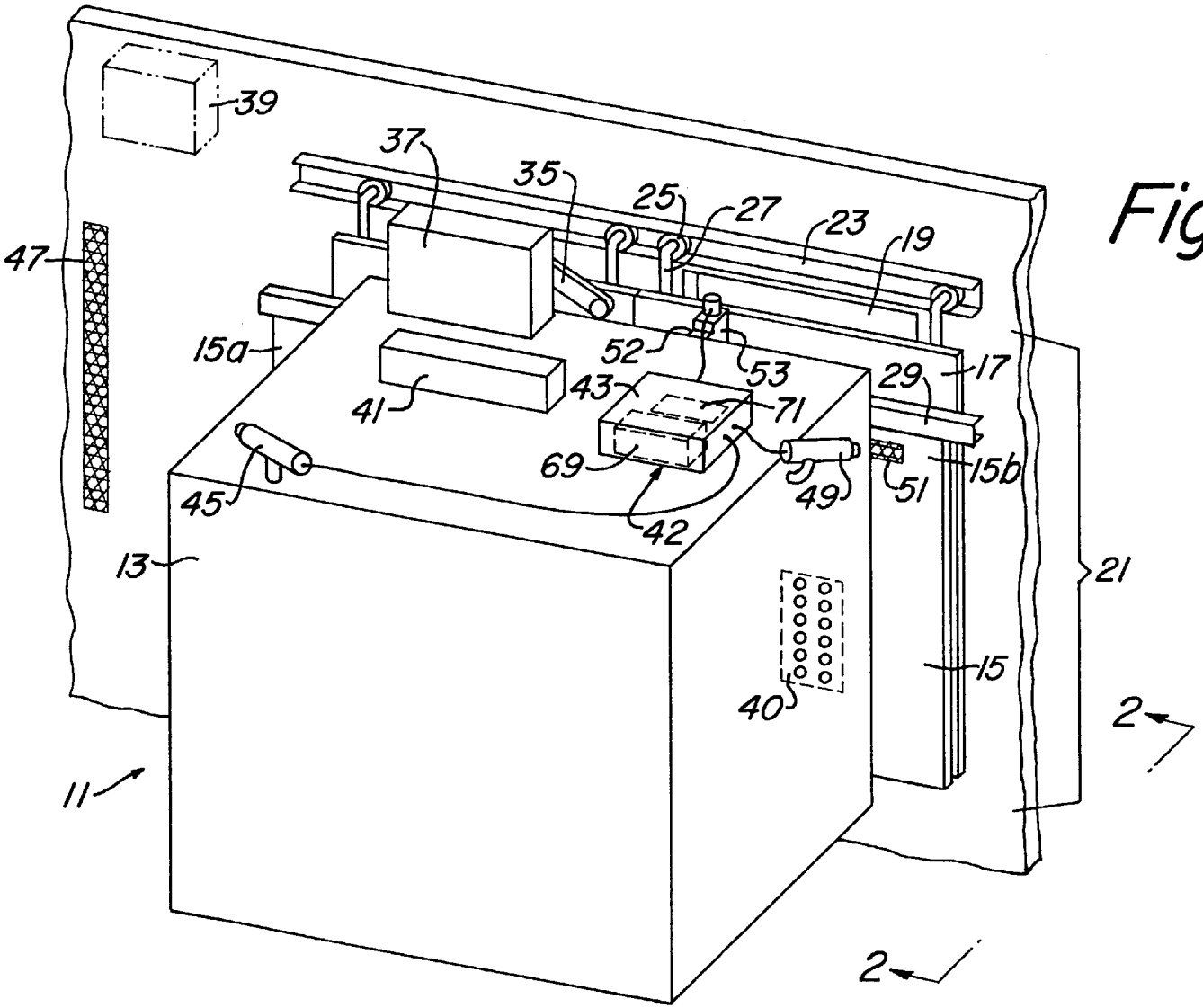
FIG. 1 is a perspective view depicting an elevator having a door restrictor made according to the present invention.

FIG. 1 is perspective view of elevator 11 having car 13 to which inner doors 15 are mounted. Car 13 travels between floors at which inner doors 15 register with outer doors 17. As shown in FIG. 1, inner doors 15 includes two doors 15*a* and 15*b* which open in opposite directions, one to the left and the other to the right. The two doors 15 are connected together so that one can not be moved without the other moving in an opposite direction. Outer doors 17 cover floor openings 19. Floor openings 19 define floor zones 21, one of which elevator car 13 is shown being disposed within. Outer doors 17 are preferably mechanically connected with inner doors 15 at each floor so that they will be moved open and closed as inner doors 15 are opened and closed.

Figure 2:
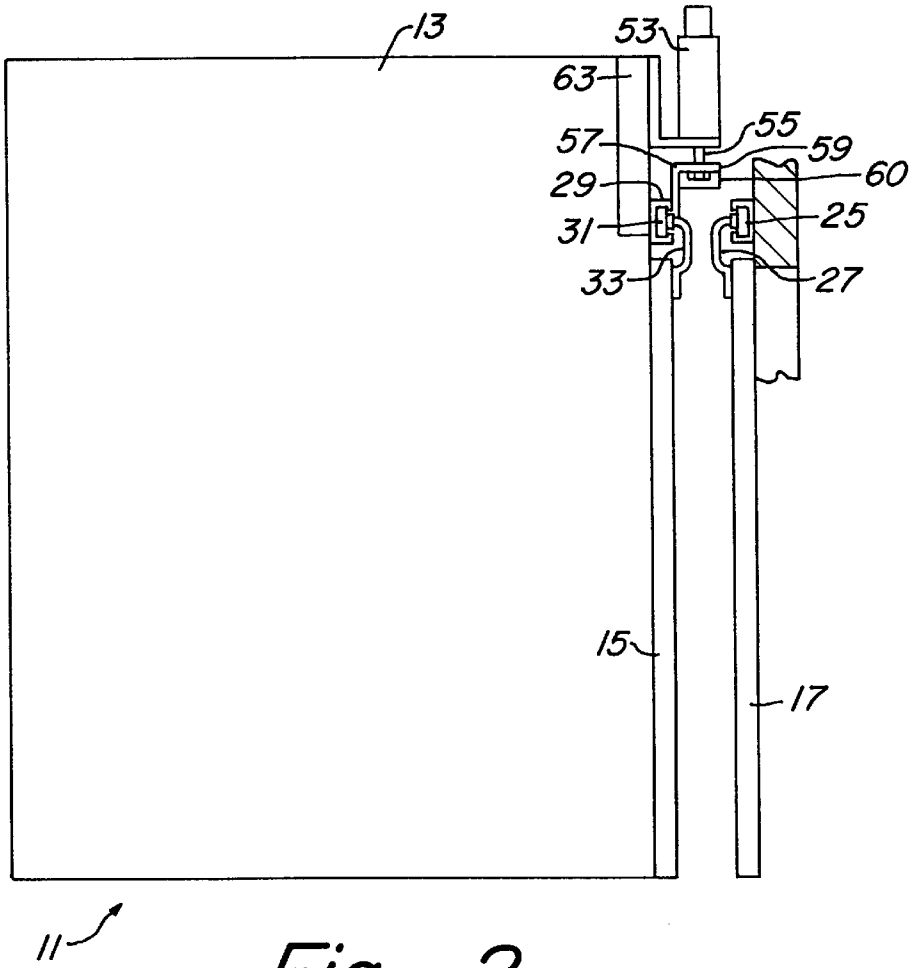
FIG. 2 is a sectional side view of the elevator of FIG. 1, taken along section line 2—2 of FIG. 1.

FIG. 2 is a side view of elevator 11, taken along line 2—2 of FIG. 1. Outer doors 17 are mounted to outer door tracks 23 which extend above floor opening 19. Rollers 25 extend into outer door tracks 23 for movably supporting outer doors 17. Mounting brackets 27 are used to mount rollers 25 to outer doors 17. Inner doors 15 are mounted to car 13 by inner door track 29. Rollers 31 extend from mounting brackets 33 into inner door tracks 29 to movably support inner doors 15. Mounting brackets 33 fasten rollers 31 to inner doors 15. A header 63 is mounted to car 13 and provides a main support to which inner door track 29 is mounted.

As shown in FIG. 1, swing arm 35 extends from inner doors 15 to a drive motor 37. Drive motor 37 is mounted to header 63. Main elevator control 39, which is depicted in phantom, is typically located at the top of the elevator shaft and is connected to control panel 40, which is mounted within car 13 for persons to select the floors to which elevator car 13 is moved. Main elevator control 39 controls vertical movement of elevator car 13 and operation of drive motor 37 to operate swing arm 35 to open inner doors 15 and outer doors 17. Wiring trough 41 extends on the top of elevator car 13 to provide power to lights which are mounted within car 13.

Referring to FIG. 1, elevator door restrictor 42 of the present invention includes controller 43, a first photo sensor 45 and a second photo sensor 49. Photo sensors 45, 49 are commercially available photoelectric sensors. First photo sensor 45 is mounted to car 13 to provide a floor zone sensor for detecting when one of reflective targets 47 (one shown) is in close proximity to sensor 45. Reflective targets 47 are preferably strips of tape having an outward facing, reflective surface. In the preferred embodiment, reflective targets 47 (one shown) are each 36 inches long and mounted to the elevator shaft so that the vertical center of one of the reflective targets 47 (one shown) will be detected when car 13 is centered within one of floor zones 21. Reflective targets 47 are up to 36 inches long so that inner doors 15 may begin to be opened while elevator car 13 is still moving into position within one of floor zones 21, within 18 inches of being centered within the floor zone. One of reflective targets 47 is mounted within each floor zone.

Second photo sensor 49 provides a door sensor for detecting when reflective target 51 has been moved. In FIG. 1, reflective target 51 is shown as being mounted to the car side of one of inner doors 15, door 15*b*. However, in other embodiments, reflective target 51 may be mounted to the other side of one of inner doors 15, such as on an angle iron mounted facing outer doors 17. As shown in FIG. 1, reflective target 51 is preferably mounted so that it will not be detected until inner door 15*b* has been opened a short distance, which is preferably not more than two inches. Additionally, the opposite end of reflective target 15 should be positioned so that second photo sensor 49 will stop detecting the presence of reflective target 51 a short distance prior to inner door 15*b* being fully opened. In other embodiments, second photo sensor 49 and reflective target 51 may be arranged such that reflective target 51 will only be detected both when inner door 15*b* is fully opened and fully closed. The primary purpose for second photo sensor 49 and reflective target 51 is to detect when doors 15 are being moved more than two inches toward the open position. Doors 15*a* and 15*b* are connected together so that one will not move without the other being moved.

Photo sensors 45, 49 are preferably mounted at an angle to reflective targets 47, 51, respectively, rather than being mounted to pass light along a line of sight which extends directly perpendicular to reflective targets 47, 51. The mounting angle between a line which extends perpendicular to the flat surface of reflective targets 47, 51 and a line of sight along which photo sensors 45, 49 emit light, respectively, should be between 10 degrees and 45 degrees. This will help prevent false signalling, such as may be occur with shiny surfaces such as stainless steel. Additionally, photo sensors 45, 49 should be installed at a minimum of 6 inches to a maximum of 6 feet from reflective targets 47, 51, respectively.

Electronic door restrictor 42 of the present invention further includes electric solenoid 53 (FIGS. 1 and 2), which acts as a latch. Electric solenoid 53 has a plunger 55 (FIG. 2) which provides a blocking member which is movable from an extended position to a retracted position. Preferably, plunger 55 will be disposed in the lower extended position prior to application of power to solenoid 53, and plunger 55 will move up to a retracted position after application of power to solenoid 53. Electric solenoid 53 is preferably a 12 volt solenoid.

Referring to FIG. 1, controller 43 controls operation of solenoid 53 in response to data signals detected by photo sensors 45, 49. Controller 43 may be mounted within elevator control panel 40, but preferably is mounted within a separate enclosure, as shown in FIG. 1. Controller 43 includes a lead acid type of storage battery 69 and a circuit board 71. External power is provided by 110 volts AC from wiring trough 41, which is used to power the lights inside of elevator car 13. Battery 69 is preferably a 12 volt DC rated battery, which provides for operation of electronic door restrictor 42 when external power is lost.

Figure 3:
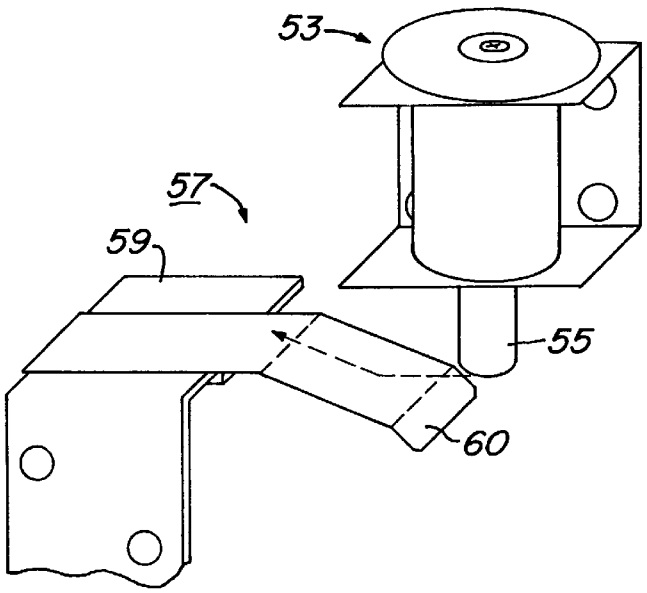
FIG. 3 is an isometric view of a solenoid and lift clip constructed in accordance with the invention.
Figure 4:
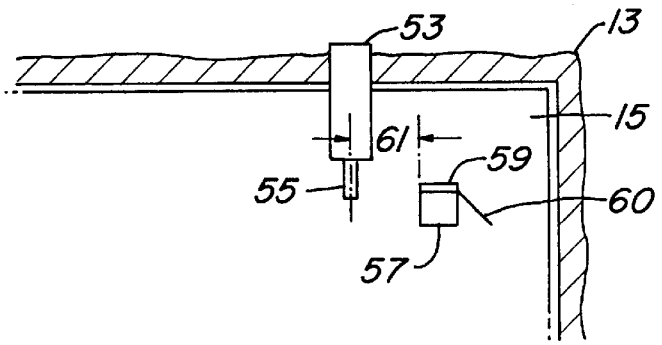
FIG. 4 is a partial front view of the elevator of FIG. 1 shown with the inner door in a closed position.

Referring to FIGS. 2 and 3, a blocking assembly 57 is mounted to one of inner door mounting brackets 33. A blocking plate 59 extends from blocking assembly 57 toward outer door 17. A lift clip 60 is mounted to blocking plate 59. Lift clip 60 has a surface which extends diagonally downward and away from solenoid 53 when inner door 15 is in the closed position (FIG. 4). Lift clip 60 is a ramp which has a lower edge that is at a lower elevation than plunger 55. Although blocking assembly 57 moves horizontally with inner door 15 relative to solenoid 53, the vertical distance between blocking assembly 57 and solenoid 53 never varies. When inner door 15 is in the fully closed position (FIG. 4), plunger 55 is horizontally separated from blocking plate 59 by a distance 61. Distance 61 is preferably not more than two inches when double inner door types are used (FIG. 1) wherein the inner doors 15 open in opposite directions. This restriction prevents inner doors 15 from being opened more than a total of four inches (two inches each) before blocking plate 59 encounters plunger 55 of electric solenoid 53. If a single inner door 15 is used (FIGS. 4–7), then inner door 15 should not move more than four inches before being blocked by solenoid 53. This restriction is required to prevent passengers from attempting to exit car 13 between floors.

When car 13 is in a floor zone and inner doors 15 begin to move to the open position, power is supplied to solenoid 53. Plunger 55 will recede within solenoid 53 (FIG. 6) to permit inner door 15 to move to the opened position (to the left). When plunger 55 is recessed, blocking assembly 57 is unobstructed and inner door 15 is free to move between the open and closed positions. In the fully open position, plunger 55 drops back to its extended position. When inner door 15 returns from the fully open position to the closed position (to the right), power is again supplied to solenoid 53 to retract plunger 55 until blocking assembly 57 moves to the right past solenoid 53 (FIG. 4). At that time solenoid 53 is disengaged and gravity drops plunger 55 to its lower position.

Figure 7:
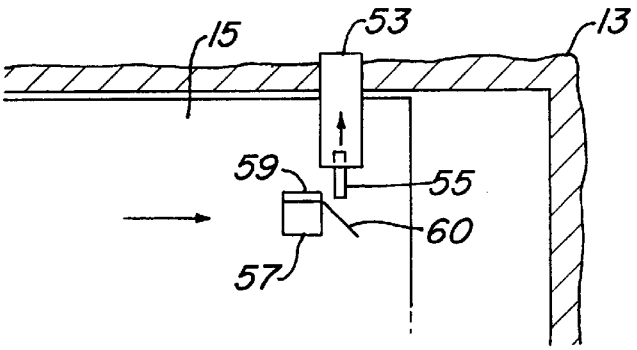
FIG. 7 is a partial front view of the elevator of FIG. 1 shown with the inner door near the closed position.

In the event of a power failure, plunger 55 will fall to and remain in its lower position. If inner door needs to be closed while plunger 55 is in its lower position, plunger 55 will contact blocking assembly 57 (FIG. 7). Lift clip 60 will strike the lower end of plunger 55, forcing it to ride up the diagonal surface and recede into solenoid 53 so that inner door 15 may close. This allows inner door 15 to be closed when there is a power loss.

Figure 8A:
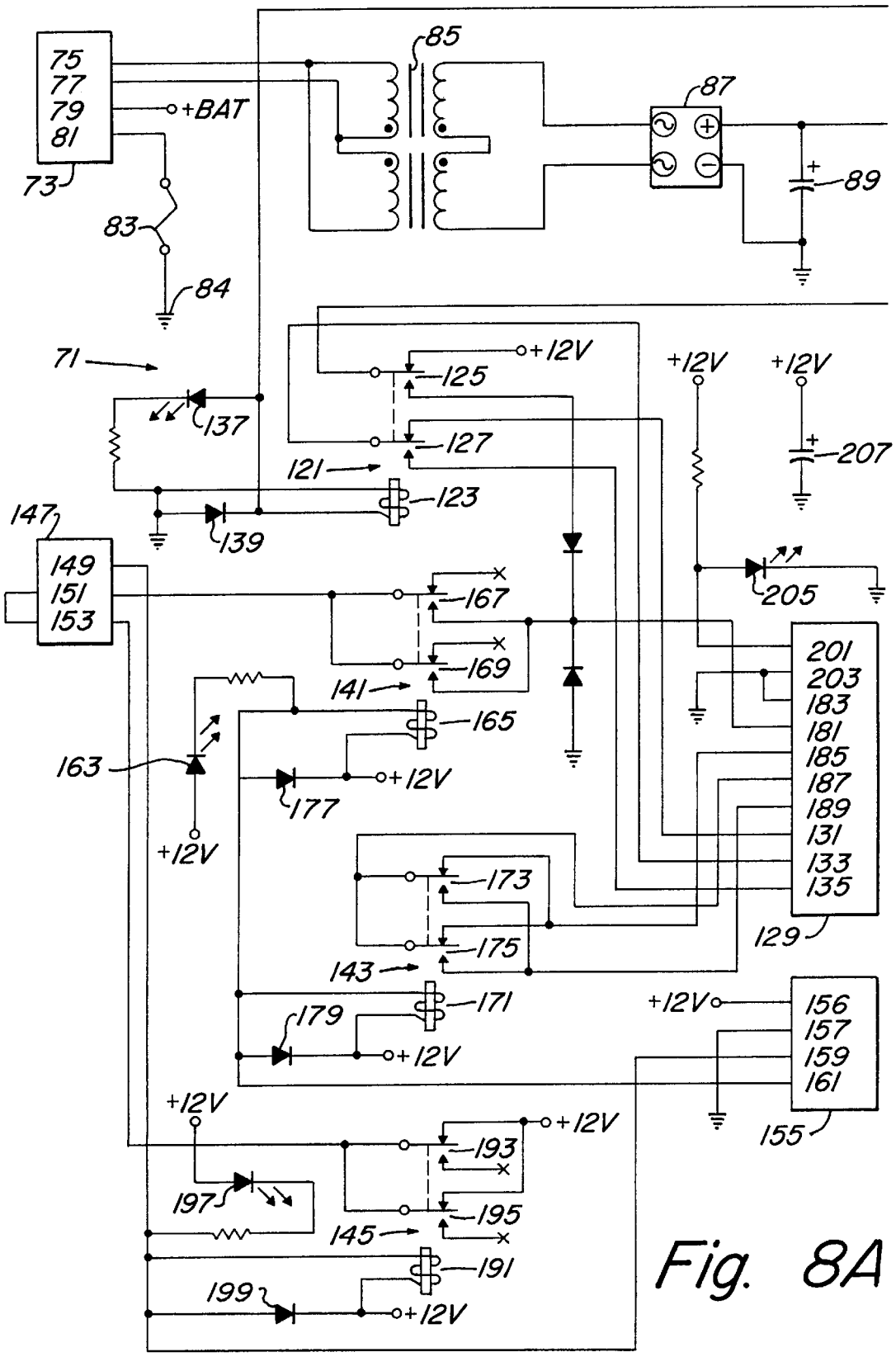
FIGS. 8A and 8B together comprise a schematic diagram depicting the electrical circuits of a controller board for a door restrictor of the present invention.
Figure 8B:
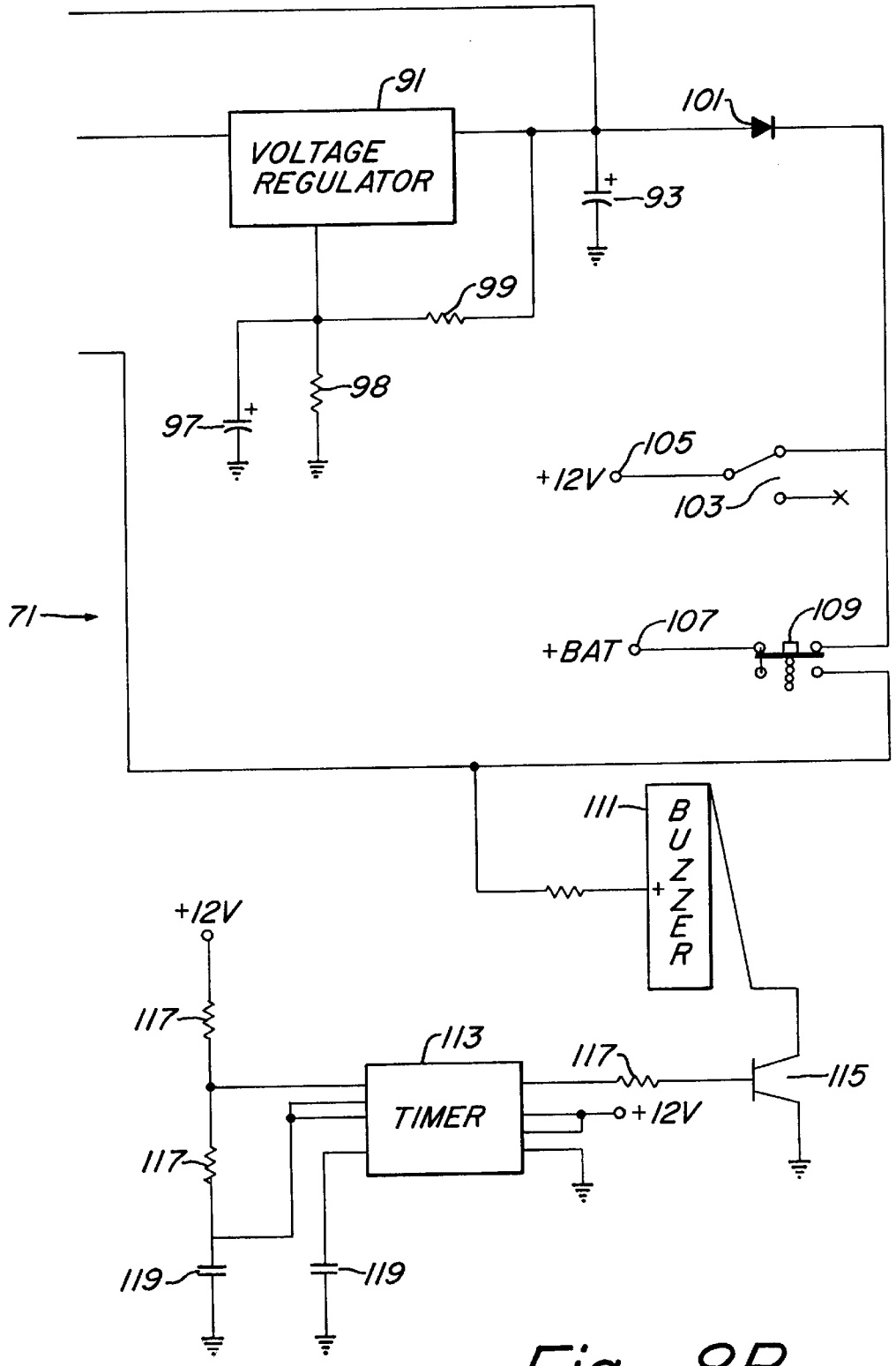

FIGS. 8A and 8B together comprise a schematic diagram depicting circuit board 71, showing the control relays mounted to board 71 in their normal positions, prior to applying power to actuate the relay coils. Circuit board 71 provides a main control for electronic elevator door restrictor 42 of the present invention. Circuit board 71 has a connector 73 with external power terminals 75, 77 which are preferably connected to 110 volts AC, single phase, found in wiring trough 41 (shown in FIG. 1). A positive battery connection 79 and negative battery connection 81 are used for connecting circuit board 71 to 12 volt rated battery 69. Ground fuse 83 is provided for fusing between the negative lead of external battery 69 and the ground 84 for circuit board 71.

Terminals 75, 77 connect to transformer 85, which is connected to rectifier bridge 87. The rated output of transformer 85 is 16 volts AC, and the rated output of rectifier bridge 87 is 18 volts DC. Capacitor 89 is provided between the output of bridge 87 and ground 84 of circuit board 71. Voltage regulator 91 is connected to the output of bridge 87 and provides a regulated output voltage of 13.6 volts DC, which provides the nominally rated 12 volts DC to power the +12 V nodes of board 71 shown in FIGS. 8A and 8B. Capacitors 93, 97, and resistors 98, 99 are connected to the voltage regulator 91.

The output voltage from regulator 91 passes through diode 101 to on/off switch 103 and test switch 109. Switch 103 is an on/off switch for connecting 12 volt power to node 105, which schematically represents the 12 volt power supplied to the circuit board. Node 107 is connected directly to terminal 79 in connector 73, which is directly connected to battery 69. The output from voltage regulator 109 will charge battery 69, passing through switch 109 in its normal position. Additionally, if switch 103 is in the on position (shown in FIG. 8B), and external power fails so that it is no longer applied to circuit board 71, battery 69 will pass electric current through switches 109 and 103 to node 105 to power circuit board 71. If switch 103 is pushed to the off position, power will not be supplied to circuit board 71 from either the battery 69 or voltage regulator 91.

Test switch 109, when pushed downward, connects electrical power from battery 69 at node 107 to buzzer 111. Buzzer 111 is connected to component 113 which includes a timing circuit so that buzzer 111 will emit a pulsed audible signal. Transistor 115, resistors 117 and capacitors 119 are also connected to timing component 113.

Still referring to FIGS. 8A and 8B, an external power detection relay 121 is schematically depicted by coil 123, and contacts 125, 127. External power detection relay 121 is shown in a normally open position, with power not being applied across coil 123. When the output from voltage regulator 91 is operating at the nominally rated 12 volts DC, power will be applied across coil 123 to energize relay 121. Terminals 131, 133 and 135 of connector 129 are connected across contact 127 of relay 121. Actuating relay 121 will open a normally closed connection across terminals 131 and 133, of connector 129, and will close a normally open connection across terminals 133, 135, of connector 129.

Terminals 131 and 133, or 133 and 135, are provided for wiring to the door open button of the elevator control panel 40 mounted within car 13, which is connected to main control panel 39. If external power is no longer applied to circuit board 71, such as if a power failure occurs, the elevator doors 15, 17 will remain open at the first floor at which the elevator stops and the doors open. Since some elevator manufacturers require normally open connections to operate the door button and other elevator manufacturers require normally closed connections, both types are provided by terminals 131, 133 and 135 at connector 129.

When external 110 voltage AC power is no longer applied to circuit board 71, contact 125 of relay 121 will move to the normally closed position (shown in FIG. 8A) to provide 12 volts DC to operate buzzer 111. The battery 69 will then supply 12 volts DC to the +12 volts nodes of circuit board 71 to power buzzer 111. Buzzer 111 will then emit the pulsed tone so that maintenance personnel may be alerted that there has been a failure of external power being applied to the elevator controller, circuit board 71, of the elevator door restrictor 42. Diode 139 is connected to coil 123 to provide surge protection when the relay 121 is actuated and released. Light emitting diode 137 will emit a light signal when external power is being applied so that a nominal 12 volt DC is being supplied by the output of voltage regulator 91.

Connector 147 has jumper terminals 149, 151, and 153. In other embodiments of the present invention, other types of proximity sensors other than photo sensors may be used in place of both photo sensors 45, 49, such as magnetic reed switches, microswitches, inductive proximity sensors and the like. Connectors 147 are provided for adapting a circuit board 71 for use when other types of proximity sensors are being used for a door sensor in place of photo sensor 49. When photo sensor 49 is utilized for detecting whether inner doors 15 are being moved, a jumper wire is connected across terminals 151 and 153 of connector 147. If another type of proximity sensor is utilized for a door sensor, other than photo sensor 49, a jumper wire is connected between terminals 149 and 151 of connector 147. The other types of proximity sensors may still be connected across terminals 156, 159 of connector 155, with the normally closed contacts of the proximity sensors connected to terminals 156, 159 to apply 12 volts DC to terminal 159 when not being actuated. These sensors should also be mounted to car 13 so that they will actuate when inner doors 15 are fully opened and fully closed.

Photo sensors 45 and 49 (shown in FIG. 1) are connected to circuit board 71 at connector 155. A plus 12 volt power connection 156 and ground connection 157 are provided. The output from photo sensor 45 (shown in FIG. 1) is connected to terminal 161. The output from photo sensor 47 (shown in FIG. 1) is connected to terminal 159 of connector 155, so that power will be applied to relay 145 when inner doors 15 are either fully opened or fully closed. Photo sensor 45 (shown in FIG. 1) is connected to terminal 161 so that terminal 161 will be connected to ground terminal 157 when a door zone is detected.

Circuit board 71 includes door zone detection relay 141, door zone output signal relay 143 and door limit relay 145. These relays control operation of electric solenoid 53 (shown in FIG. 2). When photo sensor 45 detects a door zone, terminal 161 will be connected to ground terminal 157, causing light emitting diode 163 to be turned on and actuating relays 141, 143. Passing power through coil 165 will actuate relay 141, switching contacts 167, 169 from the normal position (shown in FIG. 8A). Power being applied to coil 171 will actuate relay 143, moving contacts 173, 175 from the normal position (shown in FIG. 8A). In the normal position, without power being applied to relay 145, terminal 185 is connected to terminal 187 of connecter 129. When power is applied to actuate relay 145, contacts 173, 175 are moved from the normal position shown in FIG. 8A, opening the electrical connection between terminals 185 and 187 and closing the electrical connection between terminals 187 and 189. This provides an independent door zone signal, for use with main elevator control circuits, such as controls 39 and panel 40 (shown in FIG. 1). Both normally open and normally closed sets of terminals are provided, with 187 being a common terminal, 185 being a normally closed terminal and 189 being a normally open terminal.

When relay 141 is actuated, by passing current through coil 165 to move contacts 167, 169 from the position shown in FIG. 8A, terminal 151 of connector 147 will be connected to terminal 181 of connector 129. Terminal 181 of connector 129 is used for providing power to solenoid 53. A ground connection is provided through terminal 183 connector 129.

When photo sensor 47 is used, a jumper wire is used to connect terminal 151 to terminal 153 of connector 147. When relay 145 is in the normal position, prior to applying power through coil 191, contacts 193, 195 will be applying 12 volts DC to terminal 153, which is electrically connected to terminal 151 by a jumper wire. This will apply power to terminal 181 for powering the coil of electric solenoid 53 (shown in FIG. 1). However, relay 145 will remain in the actuated position (not shown) until inner doors 15 begin to open and reflective strip 51 passes in front of photo sensor 49. Terminal 159 is connected to the normally closed contacts of photo sensor 49, so that power will not be applied across contacts 193, 195 until doors 15 begin to open at a particular floor. Prior to photo sensor 49 detecting reflective strip 51, contacts 193 and 195 of relay 145 will be disposed in actuated positions, so that plus 12 volts DC will not be connected to terminal 153, but rather terminal 153 will be connected across contacts 193, 195 to an open circuit. Thus, inner doors 51 will remain latched until car 13 stops at a floor and doors 15 begin to open. This prevents solenoid 53 from being actuated at every floor car 13 moves past. Rather, solenoid 53 will only actuate as inner doors 15 are being opened, thereby extending the service life of solenoid 53. When photo sensor 49 detects reflective strip 51, relay 145 returns to the normal state, without current passing through coil 191, moving contacts 193, 195 to the normal position shown in FIG. 8A. This connects 12 volts DC to terminal 153 of connector 147, and to terminals 167, 169 of relay 141.

Light emitting diode 197 is provided to indicate when relay 145 is actuated. Diode 199 is a surge suppression diode for coil 191. External LED connectors 201, 203 are provide to indicate when 12 volts power is applied to circuit board 71. An LED, or other output indicator when connected across terminals 201, 203 will be powered when either external power or battery power is applied to circuit board 71. on board LED 205 also provides an indication of whether either battery power or external power is applied to circuit board 71. Capacitor 207 is provided for connecting between the +12 volt nodes and ground nodes of circuit board 71.

Operation of the present invention is now described. When car 13 enters within one of floor zones 21 (FIG. 1), photo sensor 45 will detect reflective strip 47. This sends a floor zone data signal to controller 43, as discussed above in the discussion for circuit board 71. The floor zone data signal is provided by connecting terminal 161 of connector 155 to ground terminal 157 to actuate relays 141, 143. When car 13 is stopping at one of the floors, within one of floor zones 21, inner doors 15 will be mechanically coupled to outer doors 17 and doors 15, 17 will begin to open in response to the main elevator control. This moves reflective strip 51 in front of photo sensor 49. When photo sensor 49 detects strip 51, it then sends a door data signal to controller 43. The door data signal from photo sensor 49 is provided by removing terminal 159 of connector 155 from connecting to ground terminal 157 to remove power across coil 191 and move relay 145 to a normal state (shown in FIG. 8A).

Figure 6:
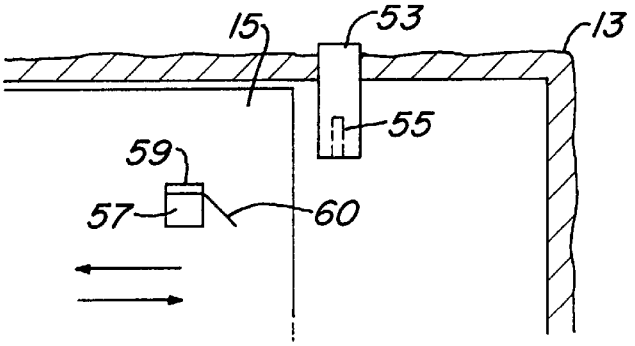
FIG. 6 is a partial front view of the elevator of FIG. 1 shown with the inner door in an open position.

When both the door data signal is emitted from photo sensor 49 and the floor zone data signal is emitted from photo sensor 45, then controller 43 will actuate solenoid 53 to pull plunger 55 upwards and out of the path of blocking member 59 so that doors 15 may be fully opened (FIG. 6). When inner doors 15 are almost fully open, reflective strip 51 will pass from in front of photo sensor 49, so that photo sensor 49 no longer passes the door data signal. This causes power to be taken off of solenoid 53, and plunger 55 falls from the retracted position back into the extended position. This will extend the service life of solenoid 53 by not continuously applying power as inner doors 15 are held open. For example, cleaning crews may frequently leave elevator doors 15, 17 open while they are cleaning a floor, taking elevator 11 out of service.

Once inner doors 15 begin to close again, reflective strip 51 will again move in front of photo sensor 49, and is detected by photo sensor 49, which then emits the door data signal. With car 13 still in position within one of floor zones 21, photo sensor 45 will still be detecting reflective strip 47. With both the floor zone and door data signals being emitted, solenoid 53 will again be actuated to move plunger 55 from the extended position into the retracted position, allowing blocking member 59 to pass underneath solenoid 53, and doors 15 to fully close. When doors 15 are fully closed, power is removed from solenoid 53 and plunger 55 drops downward to block doors 15 from being fully opened (FIG. 4). Then elevator car 13 may be moved to a new floor, at which the door opening sequence may begin again.

Figure 5:
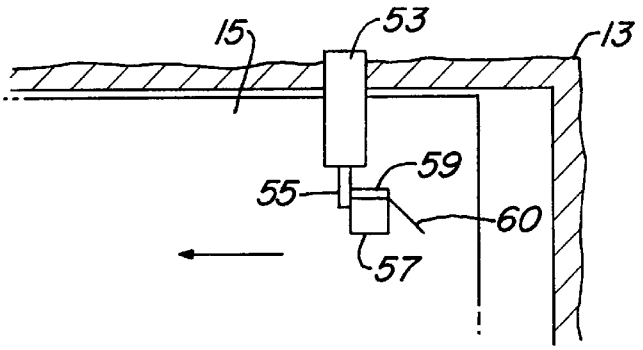
FIG. 5 is a schematic partial front view of the elevator of FIG. 1 shown with the inner door partially opened.

If elevator door restrictor 42 fails, then solenoid 53 will remain in the extended position, latching elevator inner doors 15 fully closed so that they cannot be opened more than four inches (FIG. 5). Also, when switch 103 (shown in FIG. 8B) is moved to the off position so that voltage is no longer applied to node 105, from either the external power supply of wiring trough 41 or battery 69 (shown in FIG. 1), plunger 55 will remain in the extended position so that blocking member 59 cannot pass beneath solenoid 53 and inner doors 15 cannot be opened more than four inches. A maintenance technician will have to physically remove plunger 55 or solenoid 53 from blocking inner doors 15 from opening more than four inches, or return switch 103 to the on position. If inner doors 15 open at a floor and the power is off, lift clip 60 allows inner doors 15 to be closed.

The present invention provides several advantages over prior art elevator door restrictors. An electronically controlled relay is provided for preventing the inner doors of the elevator car from being unlatched as the elevator is passing through each floor. This feature provides safer operation since the inner doors can not be pushed open as the elevator car is moving through a floor zone. This feature also provides quieter operation than mechanical latching mechanisms which are unlatched at each floor. Additionally, if a power failure occurs, a door open signal is provided once the car reaches a floor so that the elevator doors will be opened and remain open. A buzzer will sound a pulsed, intermittent, audible signal so that persons in the elevator car will evacuate the elevator and notify a service technician to repair the system. In addition, an independent floor zone signal is provided which may be used with the main elevator controls. Finally, the lift clip provided with the invention allows the inner doors to be closed at any time, even if the power to the elevator is off.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

We claim:

1. In an elevator of the type having a car, an inner door mounted to the car and outer doors mounted to floor openings located at different floors to define floor zones, wherein the inner door registers with the outer doors when the car is disposed within one of the floor zones, the improvement comprising:

a solenoid having a latch which is movable between a blocking position and a released positioned;

a striker for preventing the inner door from being opened when the latch is in the blockng position, and allowing the inner door to fully open when the latch is in the released position, the striker and the latch being mounted to the inner door and the car for movement relative to each other as the inner door moves relative to the car;

a ramp carried by the car which forces the latch to move to the releaed position when the inner door is being closed while the latch is in the blocking position; and an electrical controller for causing the latch to move to the blocking position when the inner door is substantially open.

2. The elevator of claim 1 wherein the latch is a plunger of the solenoid.

3. The elevator of claim 1 wherein the latch moves downward to the blocking position.

4. The elevator of claim 1 wherein the latch is mounted to the car and the striker is mounted to the inner door.

5. The elevator of claim 1 wherein the ramp is an inclined plate.

6. The elevator of claim 1 wherein the electrical controller causes the latch to be in the blocking position when the inner door is substantially closed and not within one of the floor zones.

7. The elevator of claim 1 wherein the ramp is mounted to the striker.

8. In an elevator of the type having a car, an inner door mounted to the car and outer doors mounted to floor openings located at different floors to define floor zones, wherein the inner door registers with the outer doors when the car is disposed within one of the floor zones, the improvement comprising:

an electric solenoid mounted to the car and having a plunger which is mounted adjacent to the inner door, the plunger having a blocking position wherein it moves downward from the solenoid and a released positioned wherein it is drawn upward into the solenoids;

a striker mounted to the inner door for contacting the plunger while the inner door is being opened and the plunger is in the blocking position and preventing the inner door from being opened, and for allowing the inner door to fully open when the plunger is in the released position;

a ramp on the striker which forces the plunger to move to the released position when the inner door is being closed and the plunger is in the blocking position; and an electrical controller for the plunger to move to the blocking position when the inner door is substantially open.

9. The elevator of claim 8 wherein the ramp is a downwardly-inclined plate.

10. The elevator of claim 8 further comprising an electrical controller for causing the latch to be in the blocking position when the inner door is substantially closed and not within one of the floor zones.

11. In an elevator of the type having a car, an inner door mounted to the car and outer doors mounted to floor openings located at different floors to define floor zones, wherein the inner door registers with the outer doors when the car is disposed within one of the floor zones, the improvement comprising:

an electric solenoid mounted to the car and having a plunger which is mounted adjacent to the inner door, the plunger having a blocking position wherein it moves downward from the solenoid and a released position wherein it is drawn upward into the solenoid;

a striker mounted to the inner door for contacting the plunger while the inner door is being opened and the plunger is in the blocking position and preventing the inner door from being opened, and for allowing the inner door to fully open when the plunger is in the released position;

a ramp on the striker which forces the plunger to move to the released position when the inner door is being closed and the plunger is in the blocking position;

floor zone sensing means for determining when the car is disposed within one of the floor zones, and for emitting a floor zone data signal in response thereto; and an electric controller operable in response to the floor zone data signal and the door data signal for automatically causing the plunger to move to the released position when the car stops at one of the floor zones.

12. In an elevator of the type having a car, an inner door mounted to the car and outer doors mounted to floor opening located at different floors to define floor zones, wherein the inner door registers with the outer doors when the car is disposed within one of the floor zones, the improvement comprising:

an electric solenoid mounted to the car and having a plunger which is mounted adjacent to the inner door, the plunger having a blocking position wherein it moves downward from the solenoid and a released positioned wherein it is drawn upward into the solenoid;

a striker mounted to the inner door for preventing the inner door from being opened when the plunger is in the blocking position, and for allowing the inner door to fully open when the plunger is in the released position;

a downwardly-inclied plate on the stker which forces the plunger to move to the released position when the plunger is in the blocking position and the inner door is being closed;

floor zone sensing means for determining when the car is disposed within one of the floor zones, and for emitting a floor zone data signal in response thereto;

an electric controller operable in response to the floor zone data signal for automatically moving the plunger to the released position when the car stops at one of the floor zones.

13. The elevator of claim 12, further comprising:

reflective targets mounted proximate to each of the floor zones, located in positions for detection by the floor zone sensing means when the car is disposed within one of the floor zones; and wherein the floor zone sensing means is a photo sensor which detects the presence of one of the reflective targets when the car is disposed within one of the floor zones.

14. The elevator of claim 12, further comprising:

reflective target means mounted to the inner door for detection by the door sensing means to determine when the inner door is being moved toward the open position; and wherein the door sensing means is a photo sensor which detects the presence of the reflective target means to determine when the inner door is being moved toward the open position.

15. The elevator of claim 12, further comprising:

power loss detecting means for detecting when external electrical power is not being applied to the electric controller;

a battery for powering the electric controller and the solenoid when external electrical power is not being applied to the electric controller;

the electric controller including control logic for emitting a power loss signal when the external power is not being applied thereto; and wherein the power loss signal is applied to a main elevator control to hold the inner and outer doors open.

* * * * *